US005283551A

United States Patent [19]

Guscott

[11] Patent Number: 5,283,551

[45] Date of Patent: Feb. 1, 1994

[54] INTRUSION ALARM SYSTEM

[75] Inventor: John K. Guscott, Hickory, N.C.

[73] Assignee: Aritech Corporation, Hickory, N.C.

[21] Appl. No.: 815,490

[22] Filed: Dec. 31, 1991

[51] Int. Cl.[5] ..... G08B 13/18

[52] U.S. Cl. ..... 340/567; 250/342; 250/349

[58] Field of Search ..... 340/567, 518, 588, 523, 340/309.15, 573; 358/105, 108, 113; 250/342, 349, 338.1

[56] References Cited

U.S. PATENT DOCUMENTS

| | | | |
|---|---|---|---|
| 4,246,480 | 1/1981 | Clark | 250/349 |
| 4,249,207 | 2/1981 | Harman et al. | 340/541 X |
| 4,618,854 | 10/1986 | Miyake et al. | 340/567 |
| 4,769,545 | 9/1988 | Fraden | 250/353 |
| 4,814,870 | 3/1989 | Crall | 358/113 |
| 4,906,976 | 3/1990 | Guscott | 340/567 |
| 4,999,610 | 3/1991 | Guscott | 340/567 |
| 4,999,614 | 3/1991 | Veda et al. | 340/567 X |
| 5,008,522 | 4/1991 | Lundin | 250/342 X |
| 5,012,099 | 4/1991 | Paturel et al. | 250/342 |
| 5,021,660 | 6/1991 | Tomita et al. | 250/349 X |
| 5,023,597 | 6/1991 | Salisbury | 340/573 X |
| 5,091,780 | 2/1992 | Pomerleau | 358/108 |

FOREIGN PATENT DOCUMENTS

| | | | |
|---|---|---|---|
| 149196 | 6/1989 | Japan | 340/567 |

*Primary Examiner*—Donnie L. Crosland
*Assistant Examiner*—Thomas J. Mullen, Jr.
*Attorney, Agent, or Firm*—Weingarten, Schurgin, Gagnebin & Hayes

[57] ABSTRACT

A passive intrusion alarm system having an array of infrared sensing elements arranged and sampled so as to provide a two dimensional thermographic image of an intruder.

6 Claims, 4 Drawing Sheets

INTRUSION ALARM SYSTEM

FIELD OF THE INVENTION

The invention relates to the field of intrusion alarm systems and more particularly to the field of passive infrared intrusion alarms.

BACKGROUND OF THE INVENTION

Passive infrared intrusion alarm systems are susceptible to false alarms caused by the detection of infrared emissions from animals or other heat sources which are not human and which do not pose a security threat. Typically, the reception of an alarm signal at a security station results in security personnel being dispatched to determine the cause of the threat. This use of security personnel to determine if an alarm indicates a real threat is expensive, especially when the monitoring station and security personnel are located at a distance from the area under surveillance.

Alternatively, the area to be monitored may be under surveillance by a more expensive video camera and occurrence of an alarm causes the security monitor to use the video camera to view the area. This technological approach, which requires special communications lines and equipment, is also expensive, especially when the area under surveillance is located a distance from the monitoring station.

The present invention provides the verification capability similar to that of a video camera but at a much reduced cost.

SUMMARY OF THE INVENTION

The invention relates to a passive infrared intrusion alarm system having an array of infrared sensors arranged and sampled so as to produce a two dimensional thermographic image of an intruder of sufficient resolution to enable security personnel to determine if a security threat exists. In one embodiment the intrusion alarm system includes a linear array of infrared sensors oriented orthogonally to the direction of anticipated intruder motion. When the presence of an intruder is detected by the intruder's infrared emissions, the intrusion alarm system is activated. Each sensor of the array is then repeatedly and sequentially accessed and the signals from each sensor are sampled and digitized. The sampled data is transmitted to a central monitoring station which generates a two dimensional thermographic image of the intruder. In a second embodiment, a microprocessor processes the digitized signals from all the sensors and generates a two dimensional thermographic representation of the intruder locally.

Using the linear array, only a few sensors are required to produce a low resolution representation of the intruder which is suitable to determine whether the intruder is human and hence whether further action need be taken. Another embodiment utilizes a two dimensional array of infrared sensors which is capable of producing a two dimensional thermographic image of a stationary intruder. Yet another embodiment mechanically sweeps a linear array of sensors across the area to be viewed.

BRIEF DESCRIPTION OF THE DRAWING

These and further benefits of the invention may be better understood with reference to the specification and the accompanying drawings in which.

DESCRIPTION OF THE PREFERRED EMBODIMENT

Figure 1:
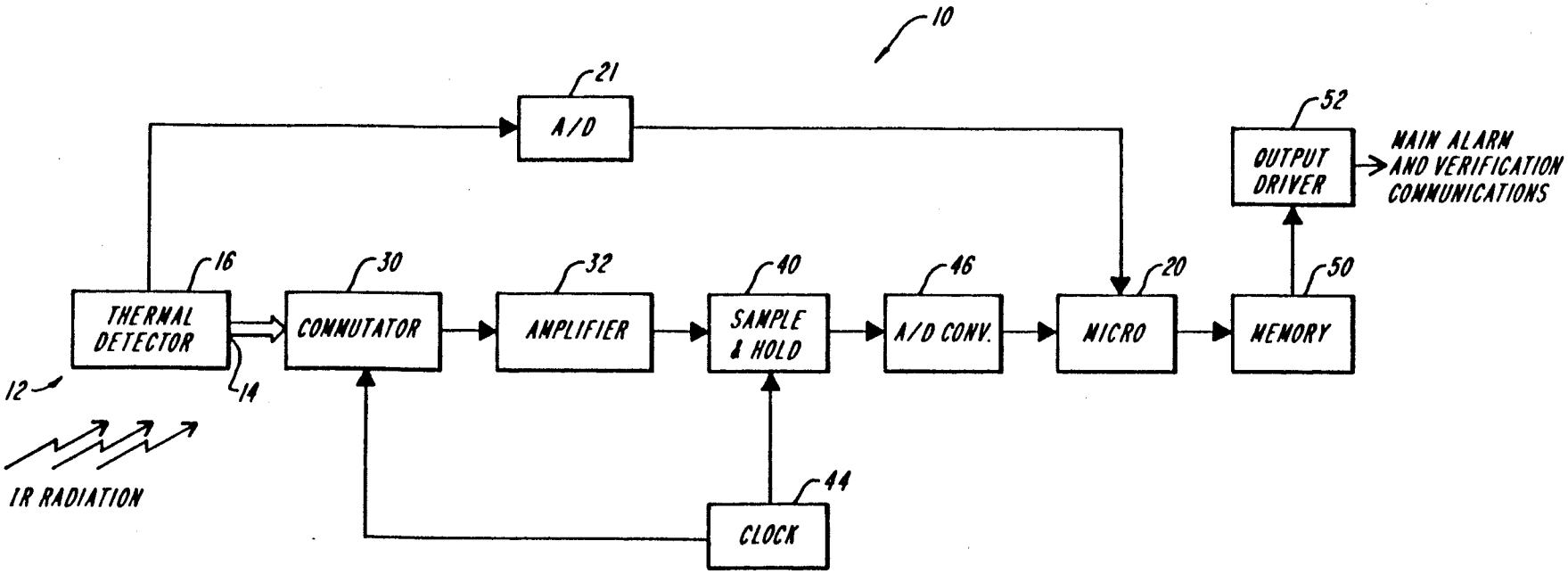
FIG. 1 is a block diagram of an embodiment of the system of the invention.

Referring to FIG. 1, in brief overview, an infrared intrusion alarm system 10 includes an infrared sensor array 12 including, in this embodiment, a linear array of sensors 14 and a triggering sensor 16. The triggering sensor 16 is in communication with a microprocessor 20, through an analog to digital converter (A/D) 21. Alternatively, the trigger sensor 16 may be connected to the microprocessor 20 through a one-shot flip-flop which produces a digital pulse which is detectable by the microprocessor 20.

The linear array of sensors 14 are connected through a commutator 30 to an amplifier 32. When activated by the microprocessor 20 in response to the signal from the trigger sensor 16, the commutator 30, as sequenced by a signal from clock 44, sequentially connects each sensor of the linear array of sensors 14 one at a time to the amplifier 32. In this manner, a single amplifier 32 may be used to amplify the signals from all the sensors of the linear array of sensors 14.

The output signal from the amplifier 32 is sampled by a sample and hold circuit 40 according to the clock signal supplied by clock 44. The use of the same clock signal to sequence the commutator 30 and to control the timing of the sample and hold circuit 40 permits the signal from the amplifier 32 to be sampled at a rate such that as each sensor of the linear array of sensors 12 is connected to the amplifier 32, the signal from that sensor is sampled only once. This sampled analog signal is converted to a digital signal by an analog to digital converter (A/D) 46, under the control of the microprocessor 20. The microprocessor 20 stores the digital signal output from the A/D 46 in random access memory (RAM) 50. The contents of the RAM memory 50 may then be accessed by an output driver 52 for transmission to another facility for processing and display. In an alternative embodiment, the microprocessor 20 may convert the digital signal from the A/D 46 into a pixel representation of the digital signal and the output driver 52 may access the pixel data stored in RAM 50 for display locally.

Figure 2:
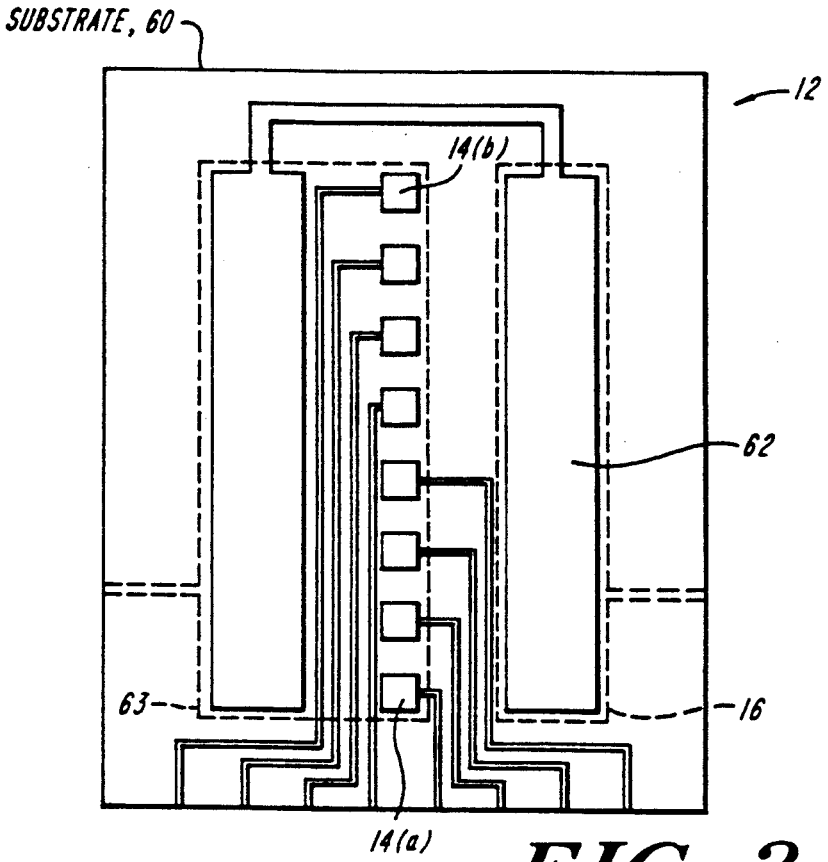
FIG. 2 is a structural representation of the infrared sensor of the embodiment of the system of FIG. 1.

Referring to FIG. 2, an embodiment of the infrared sensor array 12 constructed on a single substrate 60 is shown. In the embodiment shown, a linear array of sensors 14, having eight individual sensors 14(*a*)–14(*h*)

(only two of which are labeled for clarity) and a common electrode 62 are deposited on one surface of the substrate 60. On the opposing surface of the substrate 60 are deposited a second electrode 63 (shown in phantom) and a trigger sensor 16 (also shown in phantom). The second electrode 63 is positioned so as to be opposite to and extend beyond the boundaries of the linear array of sensors 14.

The sensors of the infrared array may be fabricated using any of the current technologies. Alternatively, the array may utilize thermopile or bolometric sensors rather than the ceramic, polyvinylidene fluoride or lithium tantalate pyroelectric sensors used in the embodiment disclosed. The number of sensors 14 is one factor in determining the resolution of the final thermographic image. However, only a few sensors need be used to provide a thermographic image of sufficient resolution to be used in verifying the nature of the intruder. Depending on the optics used in conjunction with the sensors, as few as four sensors 14 may produce a usable image.

Figure 2A:
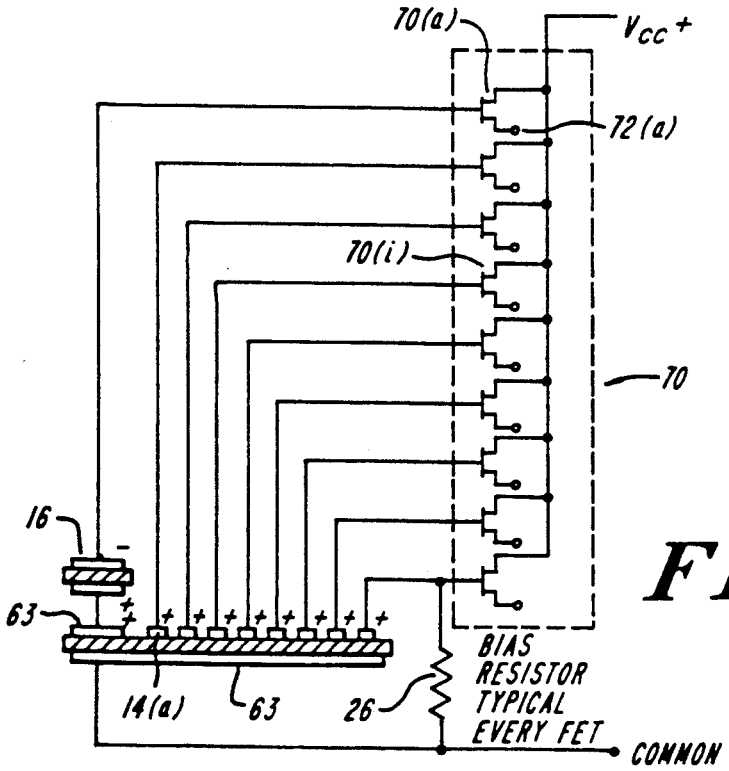
FIG. 2A is a schematic diagram the infrared sensor and buffer amplifiers of the embodiment of the invention shown in FIG. 1.

FIG. 2A, depicts a buffer amplifier array 70 used to match the extremely high impedance of the infrared sensor array 12 to the commutator 30. Each sensor 14(*a*)–14(*h*) of the linear array of sensors 14 and the trigger sensor 16 is connected to the gate of a respective one of the FET transistors 70(*a*)–70(*i*) (only two FETs being labeled for clarity) of the buffer amplifier array 70. The emitter of each FET transistor 70 is connected to a power supply (not shown), while the collector of each FET 72(*a*)–72(*i*) (only one being labeled for clarity) is in communication with the commutator 30. The voltage appearing at the collector 72 of a FET 70 is determined by the voltage on its gate, and hence, the strength of the signal detected by the sensor 14 or 16. The second electrode 63 of the infrared sensor array 12 is connected to ground. A respective bias resistor 26 (only one shown for clarity) is connected between ground and the gate of each FET 70.

Figures 3, 3A:
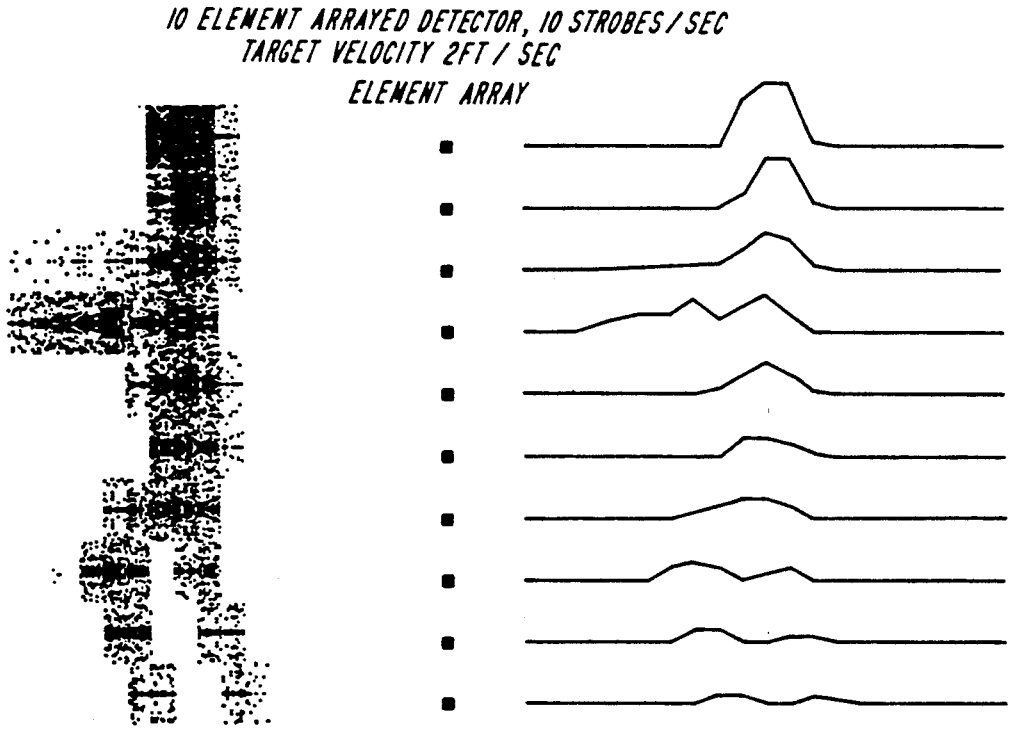
FIG. 3 is a graphical representation of the voltage signals from each element of the sensor array of FIG. 2, plotted against time, generated when a human passes by the sensor array.
FIG. 3A is a low resolution thermographic image constructed from the signals generated in FIG. 3.

Referring to FIG. 3, in operation, as an intruder passes by the infrared sensors 12, the infrared radiation emitted by the intruder is detected by the trigger sensor 16. Once the trigger sensor 16 detects the intruder, and notifies the microprocessor 20, the sensors in the linear array of sensors 14 are sampled by the commutator 30 and the digital representation of the time variation in the voltage level of the output signal from the amplifier 32 is stored in RAM 50. This data may either be transmitted to a central monitoring station or facility for conversion to a thermographic representation. Alternatively, the data from the amplifier 32 may be processed by the microprocessor 20 into pixel form prior to storing in RAM 50. The data from memory may be displayed locally as a thermographic image.

It should be noted that the system described could still function without the use of the trigger sensor 16. In this other embodiment the triggering of the system can be accomplished by requiring that a predetermined number of sensors of the linear array 14 simultaneously detect the intruder for an alarm to be generated. In yet another embodiment the system may operate without a trigger by continuously storing in memory 50 data from the sensors. It is possible to accomplish this with a finite amount of memory 50 by storing a predetermined number of samples from each sensor and then permitting the next received datum from the sensor to overwrite first received datum from the sensor. That is, assuming fifty samples from sensor one have been stored, the next sample received from sensor one overwrites sample one and the next subsequent sample overwrites sample two and so on. In order to generate a thermographic image of sufficient resolution to be useful in intruder verification, the sensors 14 must be sampled at sufficient frequency. For an intruder moving at between 0.5 and ten feet per second, each sensor should be sampled between ten and twenty times per second to generate a thermographic image of sufficient resolution. The act of an intruder passing by the linear array of sensors 14 is approximately equivalent to sweeping the linear array of sensors 14 across a stationary intruder since the motion of the intruder is in a direction perpendicular to the orientation of the array 14. Thus by setting the voltage intensity of the signal at a predetermined time equal to a given pixel value, a two dimensional thermographic representation of the intruder may be generated from the time variation of the voltage.

Figures 4, 4A:
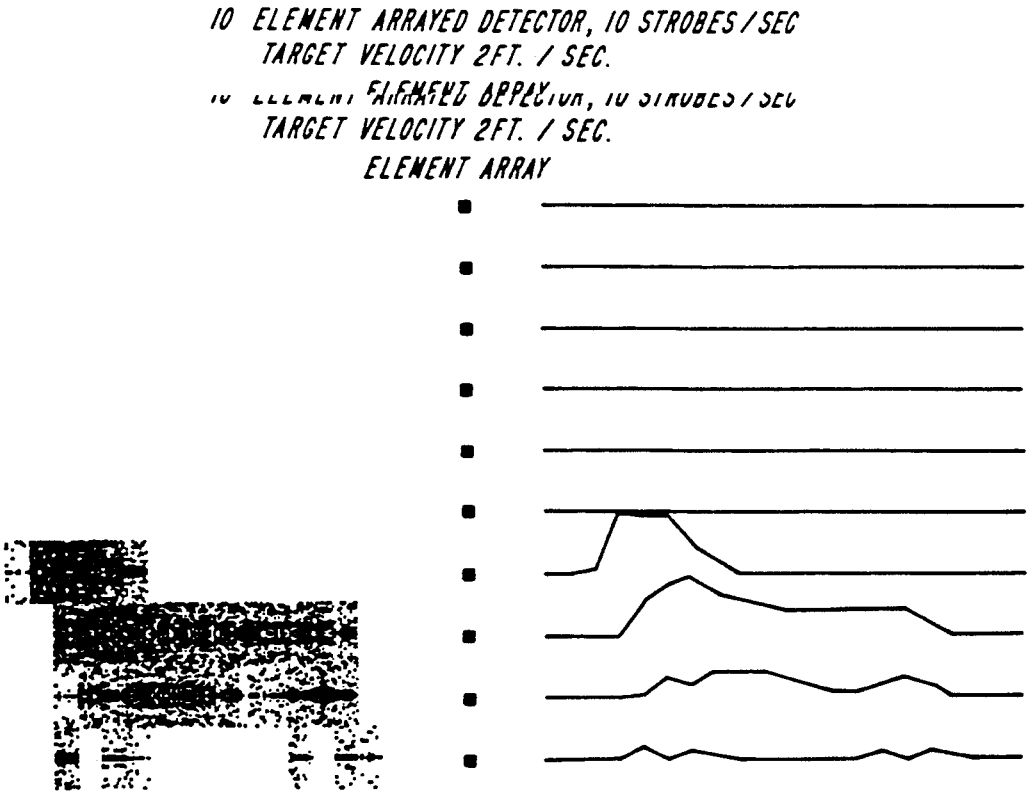
FIG. 4 is a graphical representation of the voltage signals from each element of the sensor array of FIG. 2, plotted against time, generated when a dog passes by the sensor array.
FIG. 4A is a low resolution thermographic image constructed from the signals generated in FIG. 4.

An example of the results of a human passing by the linear array of sensors 14 produces a variation in voltage over time is shown in FIG. 3 and the generated thermographic image is shown in FIG. 3A. Similarly, a dog passing before the sensors 14 produces a variation in voltage over time as shown in FIG. 4 and produces a thermographic image as shown in FIG. 4A. Such images are of sufficient resolution to distinguish whether the intruder is human or animal.

Yet another embodiment of the invention makes use of a two dimensional array of sensors 14. Because with a two dimensional array it is not necessary to allow the intruder to pass across the array in order to generate an image, the rate of sampling by the commutator 30 may be much lower than the rate of sampling of the sensor signals form a linear array. Such a system has the benefit of being able to image a stationary intruder.

Figure 5:
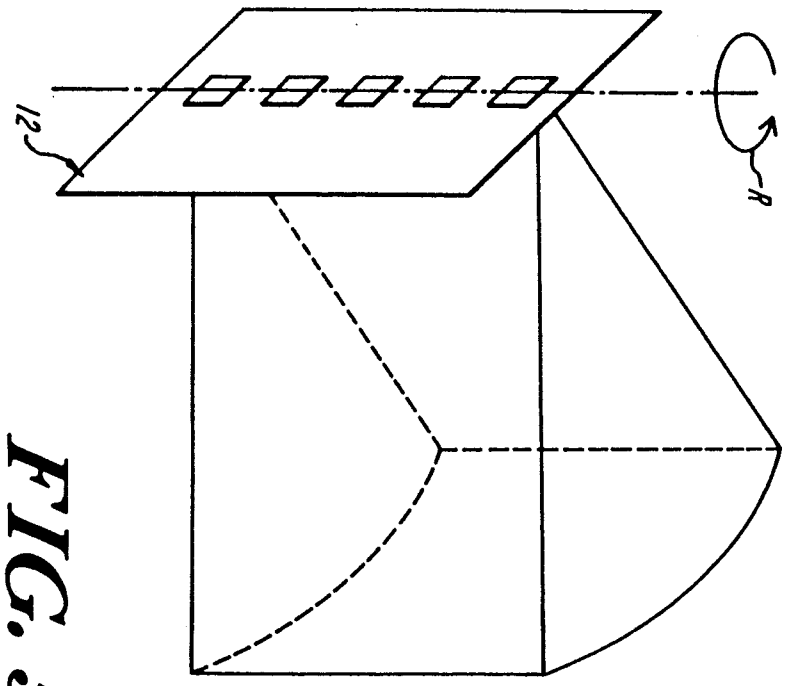
FIG. 5 is a perspective diagram of an embodiment of a sweeping linear array.

Still yet another embodiment of the invention which is capable of imaging a stationary intruder uses a linear array of sensors as described previously. However, in this embodiment the linear array of sensors 12 is mechanically moved so as to sweep the sensors across the area under surveillance (FIG. 5). Although the motion of the array 12 is shown as a rotation in the FIGURE (arrow R), a linear sweep is also possible. Such a mechanical sweep is substantially equivalent to the viewing of a moving intruder by a stationary linear array of sensors.

These and other examples of the concept of the invention illustrated above are intended by way of example and the actual scope of the invention is to be determined solely from the following claims.

What is claimed is:

1. An intrusion alarm system comprising:

a stationary linear array of infrared sensors disposed in a first plate and producing output signals in response to detection of infrared emissions from an intruder, said detection occurring when said intruder travels in a direction of motion having a component in a predetermined direction with respect to said array;

said linear array of infrared sensors oriented substantially orthogonal with respect to said predetermined direction of said component, said predetermined direction of said component being in a second plane spaced from and parallel to said first plane; and a data processing system in communication with said array of infrared sensors;

said data processing system receiving data corresponding to said output signals from said linear array of infrared sensors, and generating pixel data to provide a two dimensional thermographic image of said intruder in response to said received data.

2. The intrusion alarm system of claim 1 further comprising a trigger sensor in communication with said data processing system, said trigger sensor producing an output trigger signal in response to detection of infrared emissions from said intruder and causing said data processing system to store data corresponding to said output signals from said linear array of infrared sensors.

3. The intrusion alarm system of claim 1 further comprising a commutator in communication with each said infrared sensor in said linear array of infrared sensors, said commutator sequentially sampling the output signal from each infrared sensor in response to an output trigger signal from a trigger sensor to produce a commutated output signal.

4. The intrusion alarm system of claim 3 further comprising an analog-to-digital converter in communication with said commutator, said analog-to-digital converter converter said commutated output signal from said commutator into data for storage.

5. An intrusion alarm system comprising:

a stationary linear array of infrared sensors disposed in a first plane and producing output signals in response to detection of infrared emissions from an intruder, said detection occurring when said intruder travels in a direction of motion having a component in a predetermined direction with respect to said array;

said linear array of infrared sensors oriented substantially orthogonal with respect to said predetermined direction of said component, said predetermined direction of said component being in a second plane spaced from and parallel to said first plane;

a data processing system in communication with said array of infrared sensors and processing data corresponding to said output signals from said linear array of infrared sensors; and a central processing facility in communication with said data processing system;

said central processing facility receiving said data corresponding to said output signals from said infrared sensors from said data processing system and generating pixel data to provide a two dimensional thermographic image of said intruder in response to said received data.

6. An intrusion alarm system comprising:

a stationary linear array of infrared sensors disposed in a first plane, each of said infrared sensors producing an output signal in response to detection of infrared emissions from an intruder, said detection occurring when said intruder travels in a direction of motion having a component in a predetermined direction with respect to said array;

said linear array of infrared sensors oriented substantially orthogonal to said predetermined direction of said component, said predetermined direction of said component being in a second plane spaced from and parallel to said first plane;

a commutator in communication with each of said infrared sensors of said linear array of infrared sensors, said commutator sequentially selecting each of said infrared sensors of said linear array of infrared sensors and receiving said output signal from said selected infrared sensor to produce a commutated output signal in response to said received output signal;

an amplifier in communication with said commutator, said amplifier amplifying said commutated output signal from said commutator to produce an amplified output signal in response to said commutated output signal;

a sample and hold circuit in communication with said amplifier, said sample and hold circuit sampling and holding said amplified output signal from said amplifier to produce a sampled output signal in response to said amplified output signal;

an analog to digital converter in communication with said sample and hold circuit, said analog to digital converter converting said sampled output signal from said sample and hold circuit to a digital representation of said sampled output signal and producing a digitized output signal in response to said sampled output signal;

a microprocessor in communication with said analog to digital converter, said microprocessor receiving said digitized output signal from said analog to digital converter, processing said digitized output signal and producing pixel data in response to said digitized output signal;

a memory in communication with said microprocessor, said memory storing said pixel data produced by said microprocessor;

a display for generating a two dimensional thermographic image of said intruder from said stored pixel data;

an output driver in communication with said memory, said output driver communicating said stored pixel data from said memory to said display; and a trigger sensor in communication with said microprocessor, said trigger sensor producing an output trigger signal in response to detection of infrared emissions from said intruder, said output trigger signal triggering said microprocessor to produce said pixel data.

* * * * *

UNITED STATES PATENT AND TRADEMARK OFFICE

CERTIFICATE OF CORRECTION

PATENT NO. : 5,283,551

DATED : February 1, 1994

INVENTOR(S) : John K. Guscott

It is certified that error appears in the above-indentified patent and that said Letters Patent is hereby corrected as shown below:

Column 5, lines 22-23, "converter converter said" should read --converter converting said--.

Column 4, line 34, "signals form a" should read --signals from a--.

Signed and Sealed this

Twentieth Day of December, 1994

*Attest:*

Bruce Lehman

BRUCE LEHMAN

*Attesting Officer*

*Commissioner of Patents and Trademarks*